United States Patent [19]

Timmons

[11] Patent Number: 4,974,349

[45] Date of Patent: Dec. 4, 1990

[54] BACKHOE COMPACTOR APPARATUS

[76] Inventor: Robert Timmons, P.O. Box 384, Lewisville, Tex. 75067

[21] Appl. No.: 431,014

[22] Filed: Nov. 2, 1989

[51] Int. Cl.[5] ..... E02F 3/76

[52] U.S. Cl. ..... 37/103; 37/118 R; 37/DIG. 18

[58] Field of Search ..... 37/118 R, DIG. 18, 103, 37/DIG. 3; 404/127

[56] References Cited

U.S. PATENT DOCUMENTS

| | | | |
|---|---|---|---|
| 3,891,342 | 6/1975 | Roe | 404/127 X |
| 4,023,288 | 5/1977 | Roe | 37/103 X |
| 4,100,688 | 7/1978 | Grist | 37/DIG. 3 |
| 4,454,666 | 6/1984 | Gurries et al. | 37/118 R |
| 4,467,539 | 8/1984 | Gurries | 37/118 R |
| 4,523,397 | 6/1985 | Lucas | 37/118 R |
| 4,679,337 | 7/1987 | Carternock et al. | 37/118 R |
| 4,698,926 | 10/1987 | Caplis et al. | 37/DIG. 18 X |

*Primary Examiner*—Dennis L. Taylor
*Assistant Examiner*—J. Russell McBee
*Attorney, Agent, or Firm*—Y. Judd Azulay

[57] ABSTRACT

An improved earth compacting apparatus having the earth excavating bucket and earth compacting roller mounted to a hydraulically operated boom commonly known as a back-hoe. In said apparatus the earth compacting roller may be attached or removed without substantial modification or addition to the earth excavating bucket or manual alignment of necessary components.

The invention permits simultaneous operation of earth digging and earth compacting by one machine. An attachment hole through the supporting ribs on the back-side of the excavating bucket allows said invention to slip on the back of the excavating bucket over a link pin and one attachment pin through an introduced hole.

7 Claims, 6 Drawing Sheets

FIG. 1a
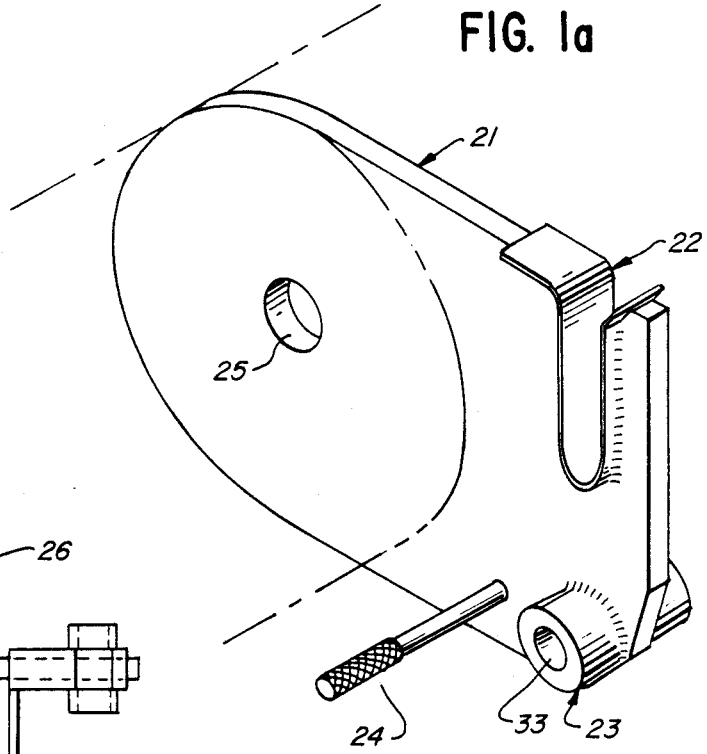
FIG. 1b
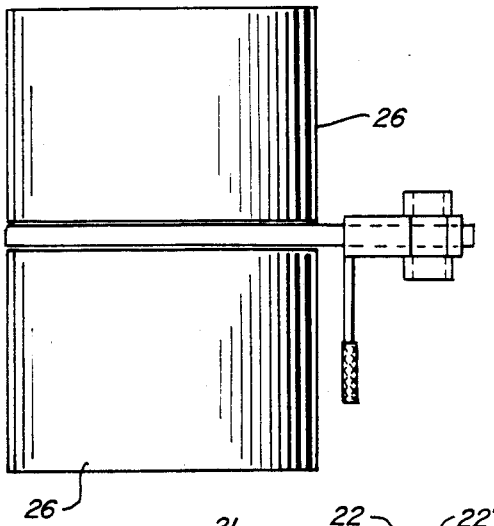
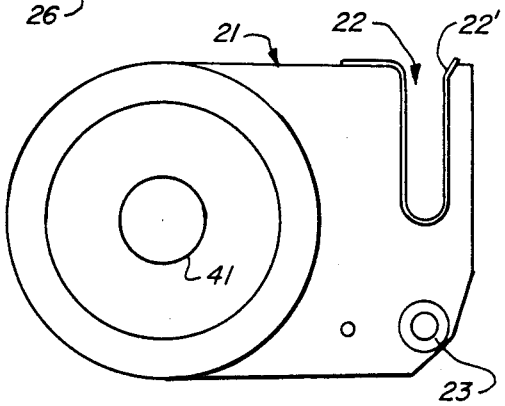
FIG. 1c
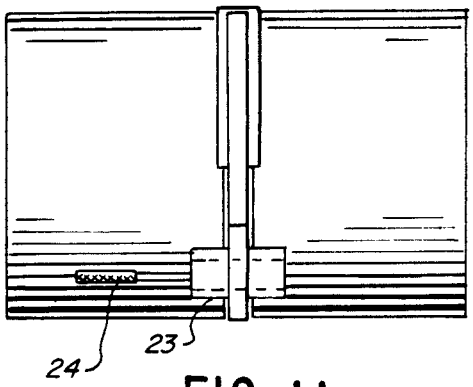
FIG. 1d

FIG. 2
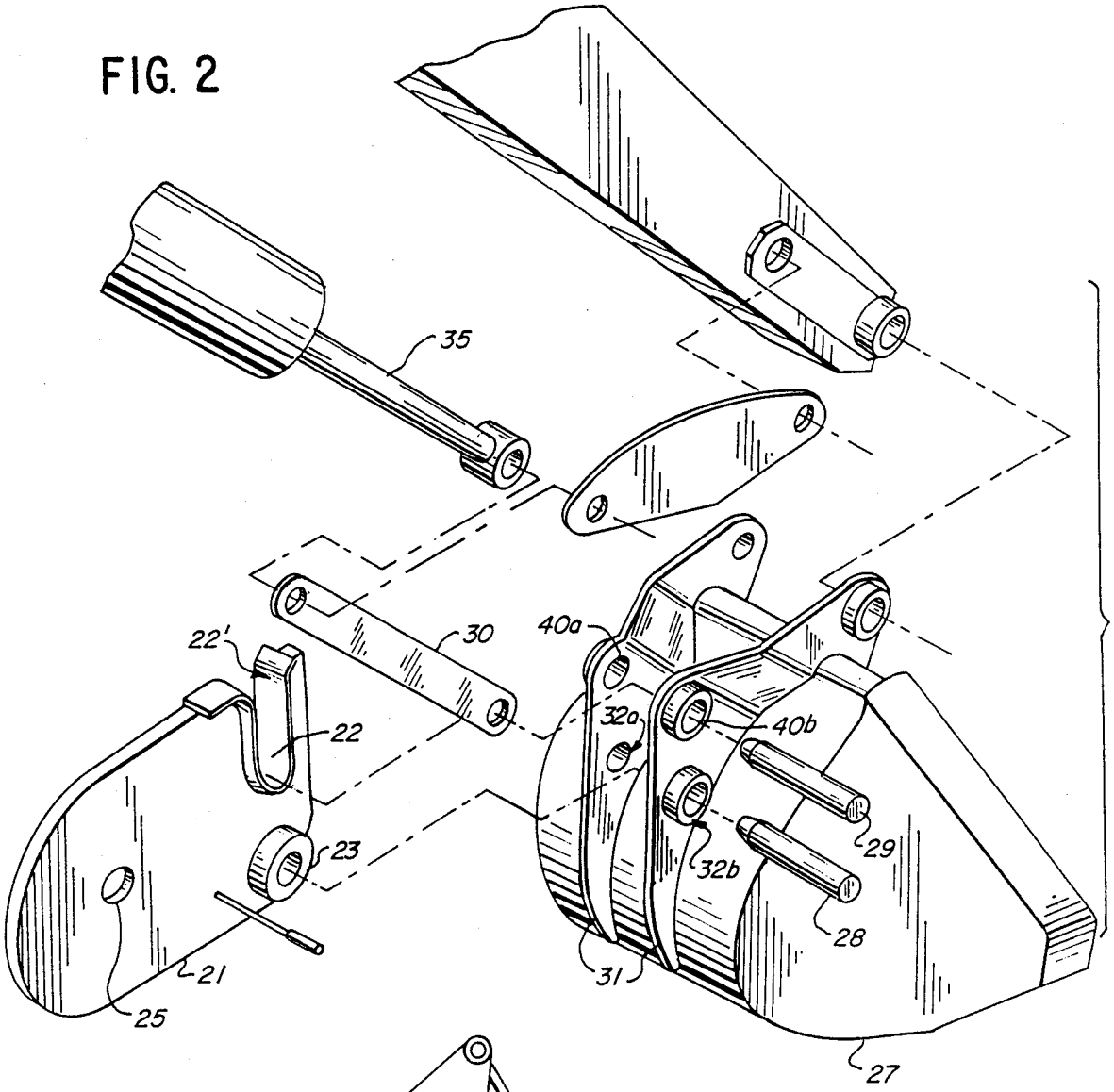
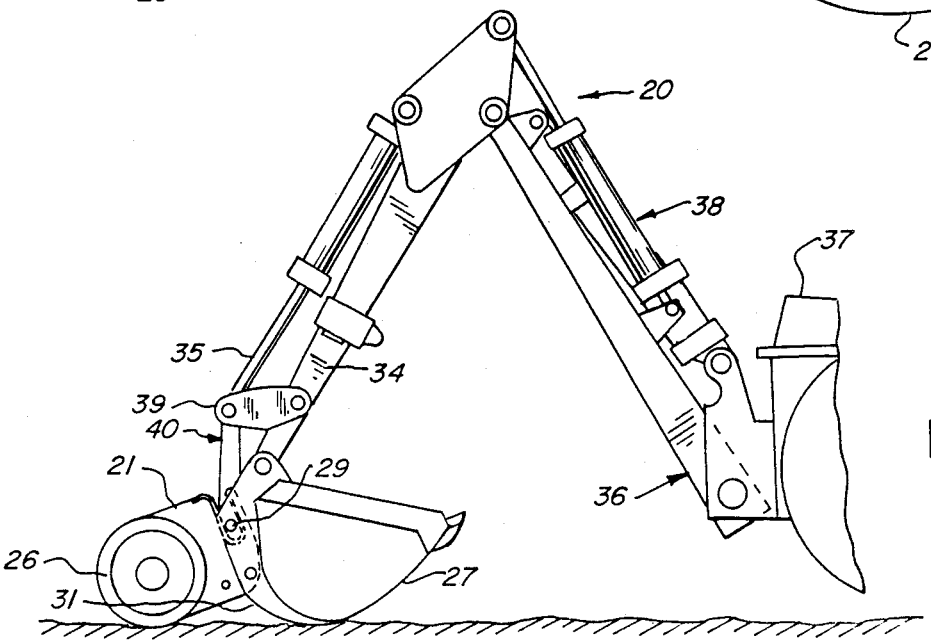
FIG. 3

FIG. 4
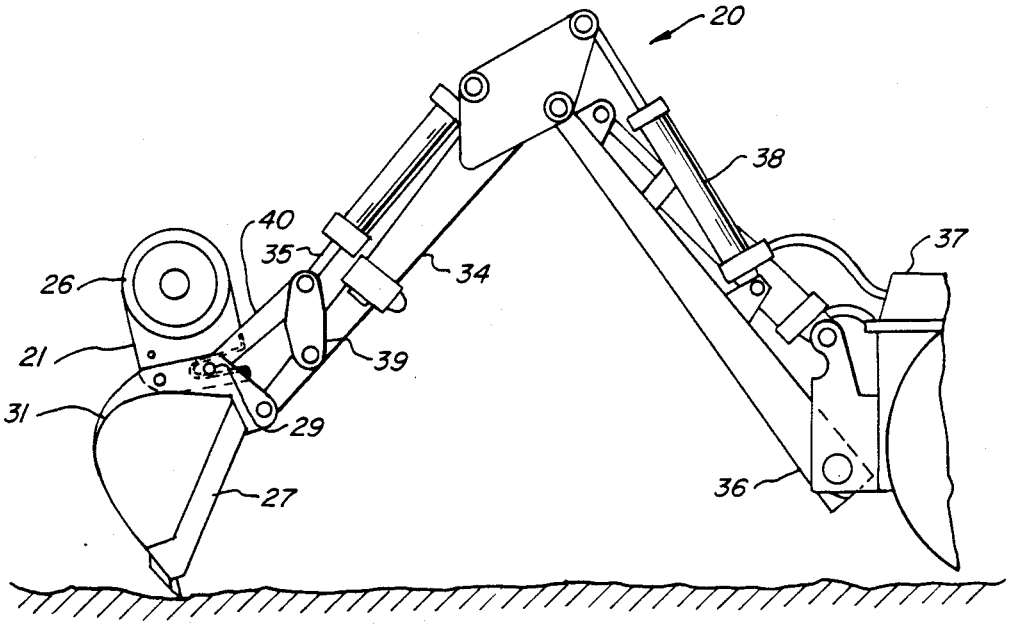
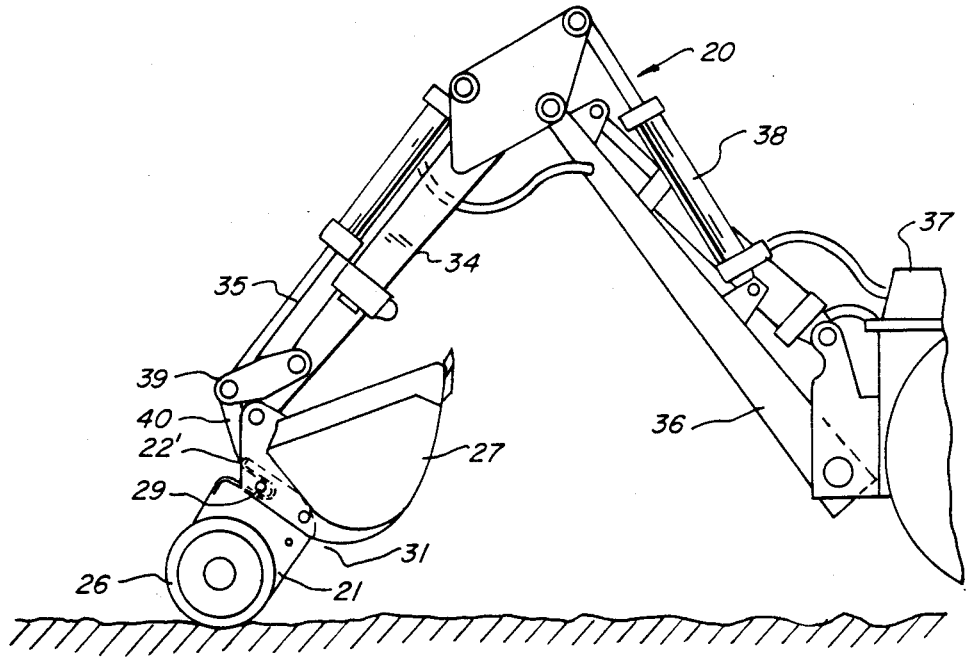
FIG. 5

FIG. 6a
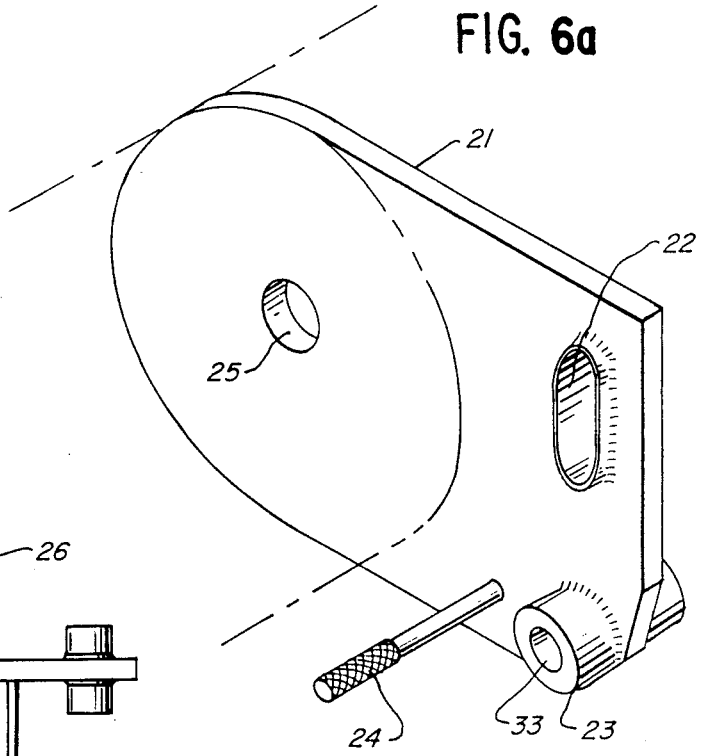
FIG. 6b
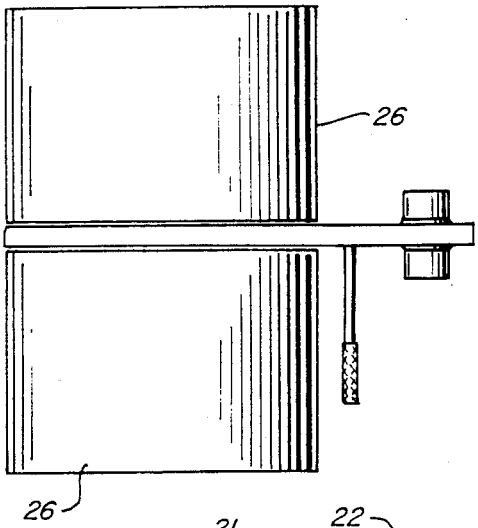
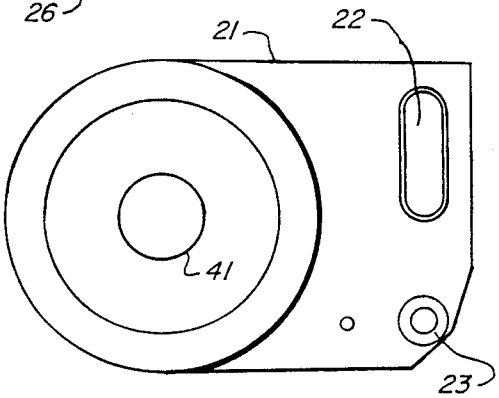
FIG. 6c
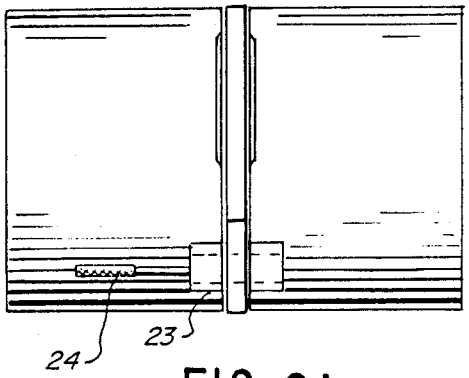
FIG. 6d

FIG. 7
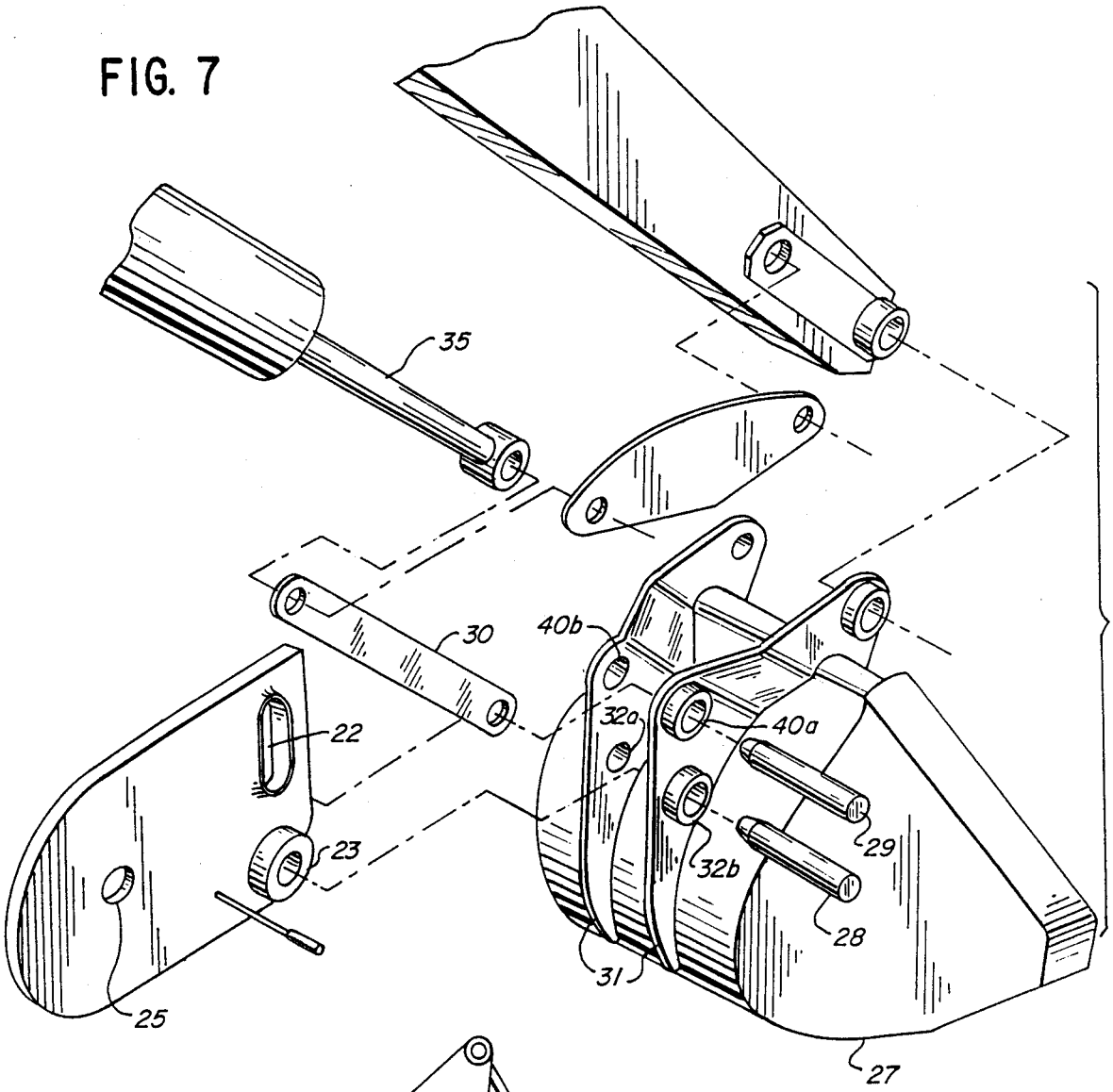
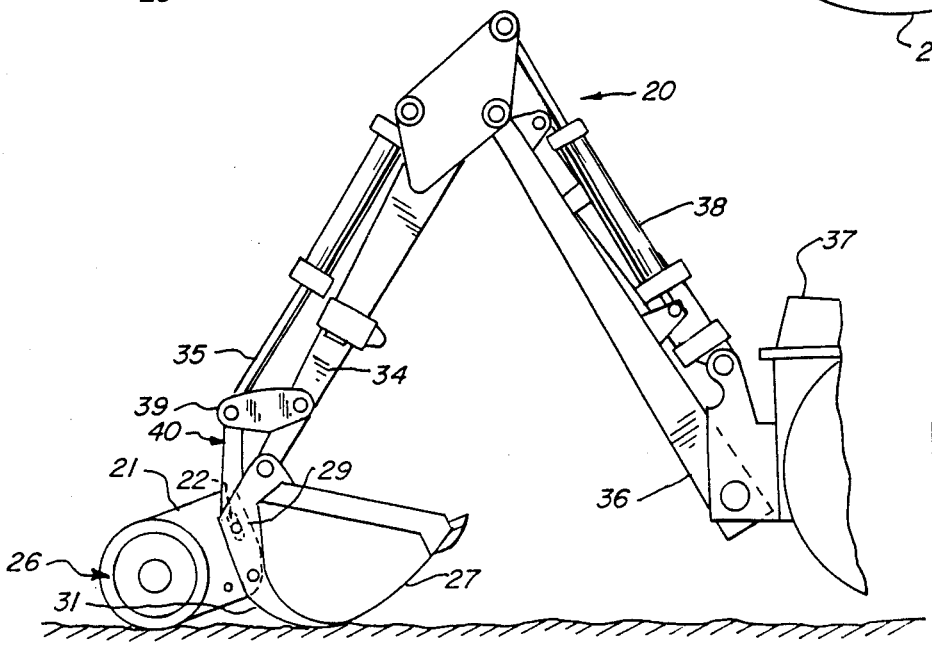
FIG. 8

FIG. 9
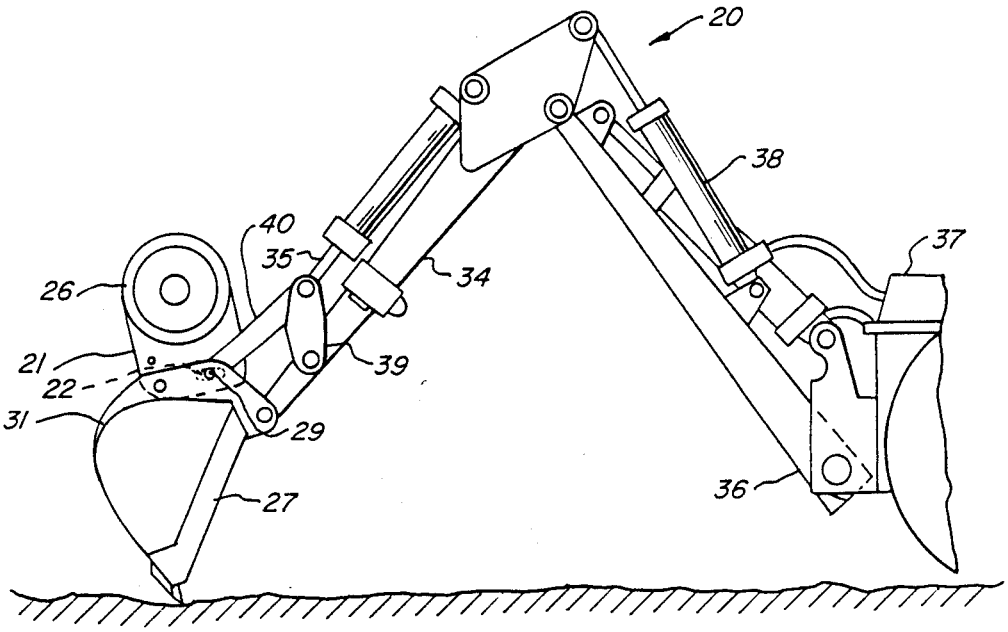
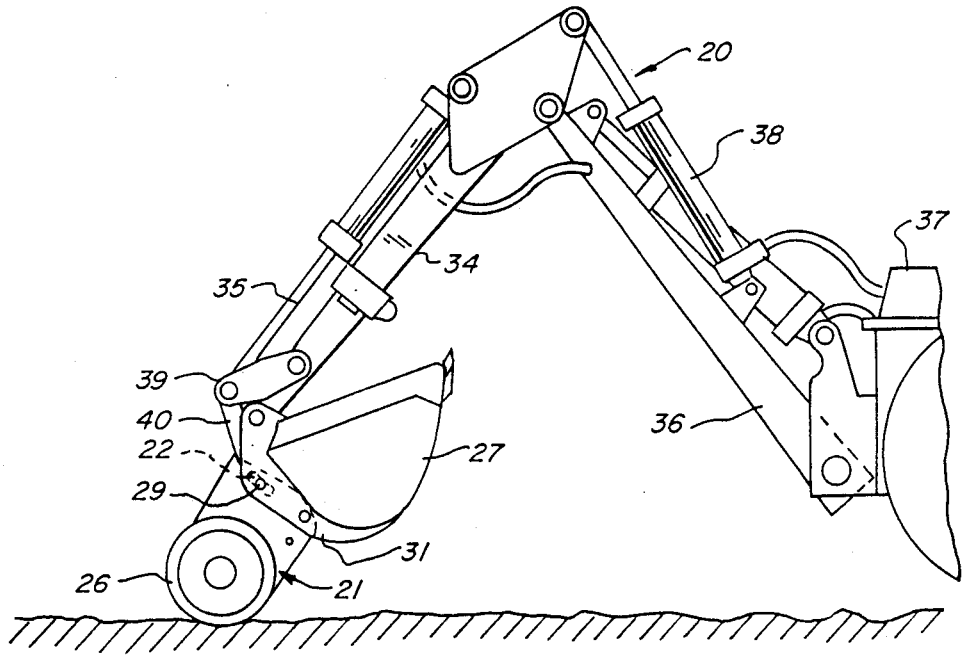
FIG. 10

BACKHOE COMPACTOR APPARATUS

BACKGROUND OF THE INVENTION

A number of commercially developed machines for digging in earth, particularly digging trenches in earth, have long been known in the construction industry. One of the most popular, efficient and cost-effective machines is a device known as a back-hoe, consisting generally of an excavating bucket attached by two or more linked arms to a vehicle such as a tractor, which provides the power to operate the device through two or more hydraulic pistons and connecting rods. Often the principal reason for trench digging is to place buried pipe, conduit or cable. To avoid subsidence or settling of the earth in the trench after refilling with earth, industry practice and often local governmental regulation, require that the floor of the trench and the earth used to refill the trench after placing the pipe or cable must be compacted. Effective compacting of the earth in the trench is usually accomplished by electrical, mechanical or pneumatic tamping machinery. Of necessity then, trench digging and filling requires more machinery and man power than just the back-hoe to dig and fill.

Over the years, in recognition of this problem, a number of inventions have been proposed to combine the earth-compacting function with the back-hoe earth-digging function to the end that only one piece of machinery be required. No prior device or invention has been able to achieve this end without substantial additional machinery, or substantial modification of the earth-digging machine, itself For example, in U.S. Pat. No. 3,891,342, the invention disclosed there required the complete removal of the excavating bucket to attach the earth-compacting invention. That arrangement is time-consuming and does not permit the earth-filling use of the bucket contemporaneously with the earth-compacting roller. U.S Pat. No. 3,595,411, discloses a similar invention wherein a compacting roller is mounted directly to the back of the excavating bucket, but the invention requires modification of the bucket, the attachment of devices to the bucket for the attachment of the invention and also contemplates a degree of accuracy in alignment of roller to bucket merely to attach the invention. In many instances in clay, mud, or wet soil, this too, is impractical. Finally, U.S. Pat. No. 4,100,688, conceived a means of attaching a roller for earth-tamping directly to a back-hoe excavating bucket by insertion of a highly modified link in the back-hoe connecting arms transmitting the digging force from the hydraulic pistons and connecting rods to the excavating bucket. This invention requires judicious selection of the material comprising the substituted link to avoid use of material which would be less strong than the factory-made link for the back-hoe machinery and a fairly high degree of machining accuracy and measurement to produce. The invention also possessed the draw-back of inserting a link into the manufacturer's design which if improperly made or installed could interfere with or weaken the back-hoe's earth-digging function. Lastly, that invention permitted the use of a roller which could never attain the width of the excavating bucket to reach to the very edges of the excavated trench, permitting a strip along both sides of the floor of the excavated trench to escape compaction.

The present invention avoids these problems by presenting a roller-compactor to be attached to the back of a back-hoe excavating bucket by the simple means of introducing a hole through the existing supporting ribs on the back-side of the excavating bucket and an attaching pin through that hole. The present invention allows the compacting roller to be speedily and easily attached to the back-hoe excavating bucket by hand lifting the attaching plate, aligning a hole or slot in the forementioned attaching plate over an existing link-pin at the excavating bucket's back-side and inserting one connecting pin. The roller permits the excavating bucket to continue its digging function while the roller is attached without hinderance or obstruction, while contemporaneously allowing the back-hoe operator to compact or tamp earth if he so wishes without removal, adjustment or modification of the invention. The present invention also permits the width of the roller to be extended to the same width as the excavating bucket, permitting the operator to compact the earth on the floor of the excavated trench right up the edges of the trench. If required or desired, the width of the roller can also be extended beyond the width of the excavating bucket for special applications.

SUMMARY OF THE INVENTION

The present invention is an improved earth compacting apparatus wherein an earth excavating bucket and a compacting roller are mounted to a hydraulically operated boom of the type generally known as a back-hoe. Also, the earth compacting roller may be easily attached without substantial modification or addition to the earth-excavating bucket Additionally, the roller may be quickly and easily removed and reattached without manual alignment of the necessary components.

This invention permits the simultaneous operation of earth-digging and earth-compacting by one back-hoe machine. This is accomplished by introducing an attachment hole or slot through the supporting ribs on the back-side of the excavating bucket, allowing the invention to slip over an existing link-pin and one attachment pin through the introduced hole. The roller attachment permits a roller width as wide as the excavating bucket.

BRIEF DESCRIPTION OF THE DRAWINGS

The novel features which are believed to be characteristic of the invention are set forth in the appended claims. The invention itself, however, together with further objects and attendant advantages thereof, will be best understood by reference to the following description taken in connection with the accompanying drawings in which:

FIGS. 1*a*–1*d*. are an exploded perspective view of one embodiment of the inventive backhoe compactor apparatus showing in detail the parts (identified as FIGS. 1*a*–1*d*) of the inventive mechanical linkage employed in the practice of the present invention.

FIG. 2. is also an exploded perspective view of the same embodiment illustrating in detail the whole of the inventive mechanical linkage utilized in the practice of the present invention.

FIG. 3. is a side elevation view illustrating the same embodiment of the inventive backhoe compactor apparatus positioned to perform a compaction operation.

FIG. 4. is a side elevation view illustrating the apparatus of FIG, 3 in position to perform an excavating operation.

FIG. 5. is a side elevation view illustrating the apparatus of FIG. 3 in a position to perform the compacting operation.

FIGS. 6*a*–6*d*. are an exploded perspective view of another embodiment of the inventive backhoe compactor appartus showing in detail the parts (identified as FIGS. 6*a*–6*d*) of the inventive mechanical linkage employed in the practice of the present invention.

FIG. 7. is also an exploded perspective view of the same embodiment illustrating in detail the whole of the inventive mechanical linkage utilized in the practice of the present invention.

FIG. 8. is a side elevation view illustrating the same embodiment of the inventive backhoe compactor apparatus positioned to perform a compaction operation.

FIG. 9. is a side elevation view illustrating the apparatus of FIG. 8 in position to perform an excavating operation.

FIG. 10. is a side elevation view illustrating the apparatus of FIG. 8 in a position to perform the compacting operation.

DETAILED DESCRIPTION WITH CLAIMS

Referring to FIGS. 1 through 3, FIG. 3 shows a conventional backhoe 20, attached to a tractor 37, with two booms, 34 and 36, at the end of which is the usual excavating bucket, 27. The backhoe 20 also includes a series of hydraulic cylinders and connecting rods, 35 and 38, to power the excavating bucket 27, and to manipulate the connecting booms 34 and 36, in various earth-moving operations.

By this invention, an attachment plate 21, having a compacting roller 26, may be quickly and easily coupled or uncoupled into an operating position on the excavating bucket 27, in operative engagement with the backhoe 20. As may be readily apparent from FIGS. 3, 4, 5, and 8, 9, 10, the compacting roller 26, attached to the excavating bucket 27, by attachment plate 21, allows full operation of the excavating bucket 27, without interference, allowing the compacting roller 26, to be brought into operation instantly at the discretion of the backhoe operator.

The present invention does not require the addition or substitution of any of the existant backhoe machinery or parts. The attachment plate 21, is coupled to the excavating bucket 27, by sliding the coupling hole or slot 22, over the existing connecting pin 29. Coupling slot 22, may be open at the end shown as 22' in FIGS. 1 and 2, or it may be closed at the end as shown in FIGS. 6 and 7. This pin 29, may be readily determined to be the attaching pin connecting the articulating back-hoe link 40, to the excavating bucket 27. In most applications, the pin 29, at FIG. 2, is inserted through existing holes 40*a*, and 40*b*, in the ribs 31, at the backside of the excavating bucket. The hydraulic cylinder and connecting rod 35, transmit power across an existing articulating link 39, to a connecting link 40, to the excavating bucket 27.

In order to assist the operator in effecting a coupling of the attachment plate 21, to the excavating bucket 27, a lifting handle 24, is provided With the back-hoe excavating bucket 27 in the general position shown by FIG. 3 or 8, the operator lifts the invention by lifting handle 24, raising the hole or slot 22, over the existing pin 29, and then inserting connecting pin 28, thus securing the attachment plate 21, quickly and easily into place. The pin 28, is not a part of the usual machinery of the backhoe excavating bucket 27, and must be provided to attach the plate 21. The pin 28, must pass through the ribs 31 on the backside of the excavating bucket 27, and a suitable boss or housing 23. Preferably, the holes made at 32*a* and 32*b*, and the ribs 31, on the excavating bucket 27, are located an appropriate distance from the pre-existant pin 29, and accomodating pre-existant holes 40*a* and 40*b*. By virtue of the slot 22, in the top of the plate 21, considerable latitude is permitted in locating coupling pin 28, and holes 32*a* and 32*b*. This pin 28, and holes 32*a* and 32*b*, are the sole modification required to be made with this invention.

The rollers 26, are attached to and are a part of the invention. They are of suitable length, preferably as wide as the excavating bucket 27. They attach to the plate 21, through the hole 25, by a suitable axle 41, or other means. Needless to say, the rollers 26, are attached prior to coupling the inventive plate 21, to the back-hoe excavating bucket 27. The rollers 26, may be parallel rollers, that is of a cylindrical shape of the type shown in FIG. 1 or tapered to a conical shape if desired. It will be readily apparent to those skilled in the art that the width, diameter, and shape of the rollers that can be used with this invention are limited only by the requirements of the backhoe operation. Disconnecting the invention is readily achieved by removing the coupling pin 28, and allowing the slot 22, at the top side of the invention to drop down past the back-hoe attachment pin 30.

It will also be quickly apparent to those skilled in the art, that other forms of earth-compacting rollers may be used such as a sheep's foot roller. The invention permits not only the use of other forms of rollers and earth compacting machinery, it does not limit the working length of the roller to the width of the excavating bucket.

I claim:

1. An improved earth excavating and compacting apparatus comprising;
   (a) at least one articulating boom, powered and manipulated by hydraulic means;
   (b) an excavating bucket with at least two supporting ribs on the backside of the bucket;
   (c) an attachment plate suitable for connecting two or more roller means through a suitable axle in said attachment plate;
   (d) an attachment means made to pass through at least two of said supporting ribs on said backside of said excavating bucket and to also pass through housing means on the attachment plate;
   (e) slotted means in the topside of said attachment plate of suitable width and depth to pass over said attachment means linking said hydraulic means to said excavating bucket, and;
   (f) handle means on the side of said attachment plate for lifting said excavating bucket in place.

2. The improved excavating and compacting apparatus of claim 1 wherein said roller means are at least the same width as or having a greater width than said excavating bucket.

3. The improved excavating and compacting apparatus of claim 1 wherein said roller means consists of rollers cylindrical in shape or of uniform radii.

4. The improved excavating and compacting apparatus of claim 1 wherein said roller comprises rollers conical in shape with the cone of smaller radius at the outermost ends of the roller.

5. The improved excavating and compacting apparatus of claim 1 wherein said slotted means are open at the top.

6. The improved excavating and compacting apparatus of claim 1 wherein said slotted means are closed.

7. An improved earth excavating and compacting apparatus comprising;

(a) at least one articulating boom, powered and manipulated by hydraulic means;

(b) an excavating bucket with at least two supporting ribs on the backside of the bucket;

(c) an attachment plate suitable for connecting at least one roller means through a suitable axle in said attachment plate;

(d) an attachment means made to pass through at least two of said supporting ribs on said backside of said excavating bucket and to also pass through housing means on the attachment plate;

(e) slotted means in the topside of said attachment plate of suitable width and depth to pass over said attachment means linking said hydraulic means to said excavating bucket, and;

(f) handle means on the side of said attachment plate for lifting said excavating bucket in place.

* * * * *